US009899726B2

(12) United States Patent
Lee et al.

(10) Patent No.: US 9,899,726 B2
(45) Date of Patent: Feb. 20, 2018

(54) ELECTRONIC DEVICE

(71) Applicants: Li-Chun Lee, Taipei (TW); Chieh-Tsao Hwang, Taipei (TW); Shih-Chia Liu, Taipei (TW); Yen-Hao Yu, Taipei (TW); Jhin-Ciang Chen, Taipei (TW)

(72) Inventors: Li-Chun Lee, Taipei (TW); Chieh-Tsao Hwang, Taipei (TW); Shih-Chia Liu, Taipei (TW); Yen-Hao Yu, Taipei (TW); Jhin-Ciang Chen, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 264 days.

(21) Appl. No.: 14/140,484

(22) Filed: Dec. 25, 2013

(65) Prior Publication Data

US 2014/0104121 A1 Apr. 17, 2014

Related U.S. Application Data

(63) Continuation-in-part of application No. 13/854,971, filed on Apr. 2, 2013.

(Continued)

(51) Int. Cl.
*H01Q 13/10* (2006.01)
*H01Q 1/24* (2006.01)

(Continued)

(52) U.S. Cl.
CPC ..... *H01Q 1/24* (2013.01); *H01Q 1/2266* (2013.01); *H01Q 1/44* (2013.01); *H01Q 13/10* (2013.01)

(58) Field of Classification Search
CPC ..... H01Q 1/24; H01Q 13/10; H01Q 1/2266; H01Q 1/44
See application file for complete search history.

(56) References Cited

U.S. PATENT DOCUMENTS 7,339,533 B2 3/2008 Kurashima et al.
2008/0143613 A1* 6/2008 Iwai ..... H01Q 1/243 343/702

(Continued)

FOREIGN PATENT DOCUMENTS

JP 2006042042 2/2006
TW I350027 10/2011

OTHER PUBLICATIONS

"Office Action of Taiwan Counterpart Application", dated Aug. 4, 2015, p. 1-p. 5.

(Continued)

*Primary Examiner* — Graham Smith
*Assistant Examiner* — Noel Maldonado
(74) *Attorney, Agent, or Firm* — JCIPRNET

(57) ABSTRACT

An electronic device including a first casing, a second casing, at least one first connecting unit and at least one feeding unit is provided. The first casing includes a conductive material. The second casing includes a conductive material. The first casing and the second casing are conducted with each other through the first connecting unit. The feeding unit is electrically connected to the first casing and has a feeding point and a capacitor component, wherein the capacitor component is connected with the feeding point, and the electronic device forms an antenna structure with the first casing, the second casing, the first connecting unit and the feeding unit and transmits an electromagnetic signal via the feeding unit.

16 Claims, 5 Drawing Sheets

Related U.S. Application Data

(60) Provisional application No. 61/648,609, filed on May 18, 2012.

(51) Int. Cl.
*H01Q 1/22* (2006.01)
*H01Q 1/44* (2006.01)

(56) References Cited

U.S. PATENT DOCUMENTS

| | | | | |
|---|---|---|---|---|
| 2009/0033551 | A1* | 2/2009 | Hsu | G01S 19/36 342/357.64 |
| 2010/0207826 | A1 | 8/2010 | Ryou et al. | |
| 2013/0293426 | A1* | 11/2013 | Hung | H01Q 1/521 343/702 |

OTHER PUBLICATIONS

"Office Action of parent, U.S. Appl. No. 13/854,971," dated Feb. 4, 2015, p. 1-p. 10.

* cited by examiner

ELECTRONIC DEVICE

CROSS-REFERENCE TO RELATED APPLICATION

This application is a continuation-in-part application of and claims the priority benefit of a prior application Ser. No. 13/854,971, filed on Apr. 2, 2013, now pending. The prior application Ser. No. 13/854,971 claims the priority benefit of US Provisional application Ser. No. 61/648,609, filed on May 18, 2012. The entirety of each of the above-mentioned patent applications is hereby incorporated by reference herein and made a part of this specification.

BACKGROUND

Field of the Application

The invention relates to an electronic device, and more particularly, to an electronic device capable of transmitting and receiving an electromagnetic signal.

Description of Related Art

Following the advancement of technology, current mass communication means have gradually been changed to wireless communication; devices such as smart phone, tablet PC with wireless Internet access, notebook computer and so forth are all fall within the scope of wireless communication; and in general, the wireless communication requires the use of an antenna to transmit messages.

Under a condition that a design of the electronic device is increasingly become light and thin, if the electronic device has a metal shell, the antenna, in case of limited configuration space, is more difficult to be configured away from the metal shell, thereby causing the signal of the antenna to be influenced by the metal shell. For example, most antenna of the notebook computer is disposed at a display screen thereof, and the display screen has the metal shell. In order to prevent the antenna from being too close to the metal shell and influence a transmission and reception of the signal, the antenna has to be installed at a peripheral portion of the display screen. As such, the configuration of the antenna is being limited and a difficulty in designing the antenna is increased.

SUMMARY OF THE APPLICATION

The invention provides an electronic device having favorable signal transmission and reception ability.

The electronic device of the invention includes a first casing, a second casing, at least one first connecting unit and at least one feeding unit. The first casing includes a conductive material. The second casing includes a conductive material. The first casing and the second casing are conducted with each other through the first connecting unit conducts. The feeding unit is electrically connected to the first casing and has a feeding point and a capacitor component, wherein the capacitor component is connected with the feeding point, and the electronic device forms an antenna structure with the first casing, the second casing, the first connecting unit and the feeding unit and delivers an electromagnetic signal via the feeding unit.

In an embodiment of the invention, the capacitor component is connected in parallel with the feeding point.

In an embodiment of the invention, the electronic device further includes a cover, wherein the cover is fixed on the first casing and covers the first connecting unit, and the feeding unit is disposed in the cover.

In an embodiment of the invention, the feeding unit is electrically connected to the first connecting unit.

In an embodiment of the invention, the feeding unit includes a substrate and a circuit, the substrate is fixed between the first casing and the first connecting unit, the circuit is disposed on the substrate and has two connecting ends connected to the first casing and the first connecting unit respectively, the feeding point is located on the circuit, and the capacitor component is disposed on the substrate and connected with the feeding point through the circuit.

In an embodiment of the invention, the feeding unit includes a metal component, the metal component is fixed between the first casing and the first connecting unit and has two connecting ends connected to the first casing and the first connecting unit respectively, the feeding point is located on the metal component, and the capacitor component is disposed on the metal component and connected with the feeding point through the metal component.

In an embodiment of the invention, a lateral side of the first casing and a lateral side of the corresponding second casing have a gap there between, and the first connecting unit and the feeding unit are disposed at in the gap.

In an embodiment of the invention, each lateral side has a distal end, the distal end is adjacent to the first connecting unit, and the feeding unit is located between the distal end and the first connecting unit and near the first connecting unit.

In an embodiment of the invention, each lateral side has a distal end, the distal end is adjacent to the first connecting unit, and a distance between the first connecting unit and the distal end of each lateral side equals to $(n\times\lambda)/4$, wherein n is an integral number, and $\lambda$ is a wavelength of the electromagnetic signal.

In an embodiment of the invention, the electronic device further includes at least one second connecting unit, wherein the second connecting unit conducts the first casing and the second casing with each other, and the first casing, the second casing, the first connecting unit and the second connecting unit form a slot there between.

In an embodiment of the invention, a length of the slot equals to $(n\times\lambda)/2$, wherein n is an integral number, and $\lambda$ is a wavelength of the electromagnetic signal.

In an embodiment of the invention, the feeding unit includes a base body, a conductive element and an elastic element. The base body is disposed within the second casing. The conductive element is disposed on the base body, wherein a first end of the conductive element is in contact with the first casing, and a second end of the conductive element is connected to a feed line. The elastic element is connected between the base body and the second casing, wherein the conductive element is in continuous contact with the first casing via an elastic force of the elastic element.

In an embodiment of the invention, the first end of the conductive element is a spherical structure, a pillar structure or a sheet structure.

In an embodiment of the invention, the conductive element includes an elastic structure.

In an embodiment of the invention, the base body includes a conductive material, and the base body is connected to a ground wire and in contact with the second casing.

In an embodiment of the invention, the feeding unit further includes an insulating element, a portion of the conductive element is located within the base body, and the insulating element is filled in the base body so as to electrically isolate the conductive element from the base body.

In an embodiment of the invention, the first connecting unit is a pivoted unit, and the first casing and the second casing are pivoted with each other via the pivoted unit.

According to the foregoing, the electronic device of the invention conducts the first casing and the second casing with each other through the first connecting unit, and is configured with the feeding unit that connects the first casing, so as to transmit and receive the electromagnetic signal via the antenna structure formed by the first casing, the second casing, the first connecting unit and the feeding unit, and to deliver the electromagnetic signal via the feeding unit. As a result, the electronic device is not required to be configured with an additional antenna, and may avoid the conductive first casing and second casing from causing interference to a signal of the additional antenna, so as to enhance the signal transmission and reception ability of the electronic device. Besides, the feeding unit has a capacitor component and the capacitor component is connected with the feeding point of the feeding unit so as to increase the impedance of the feeding point, such that a resonance of signal at the feeding unit is ensured.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DETAILED DESCRIPTION OF DISCLOSED EMBODIMENTS

Figure 1:
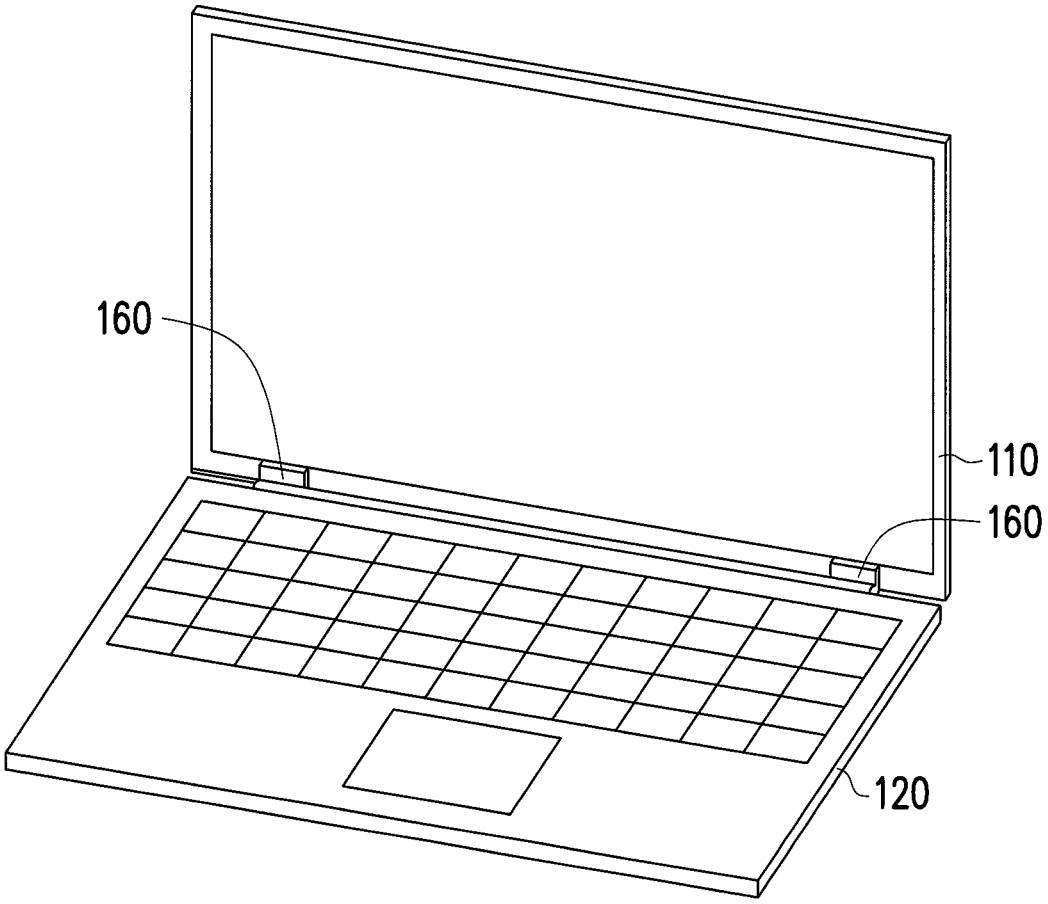
FIG. 1 is a perspective view illustrating an electronic device according to an embodiment of the invention.
Figure 2:
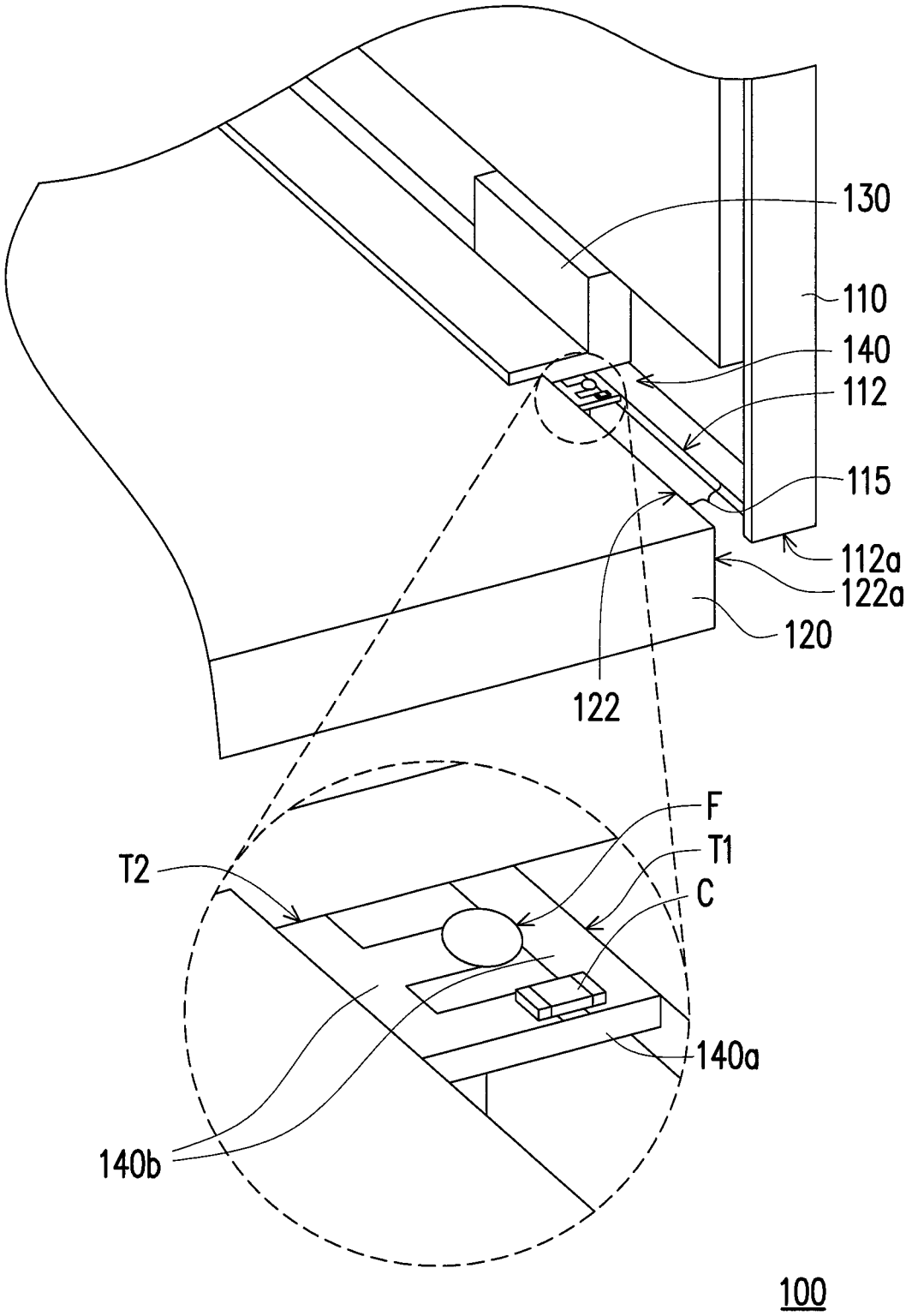
FIG. 2 is a partial perspective view illustrating the electronic device of FIG. 1.
Figure 3:
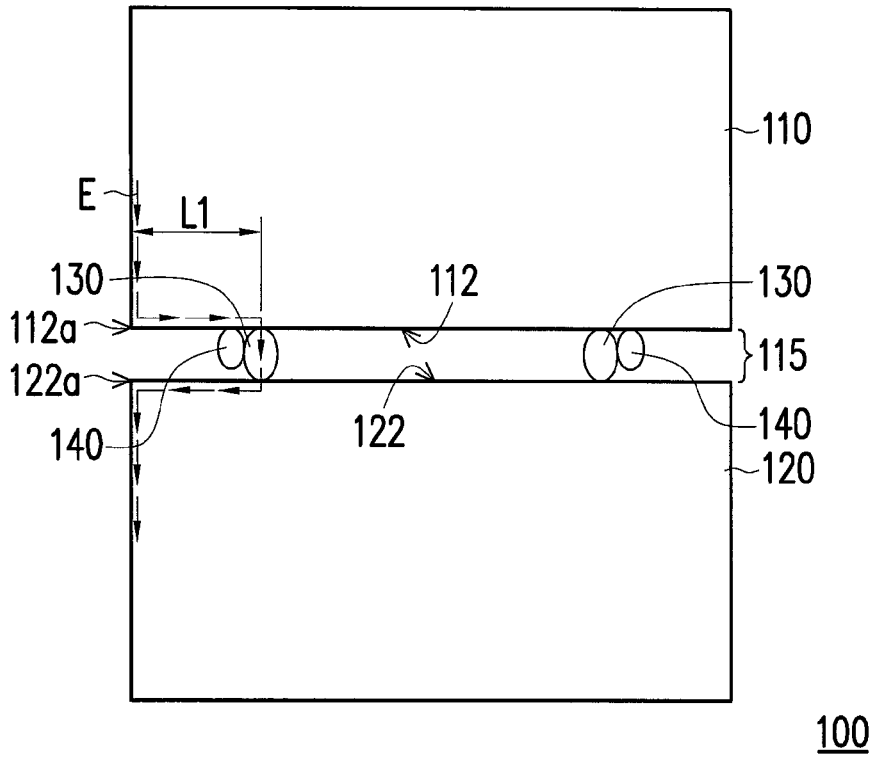
FIG. 3 is a schematic diagram illustrating the electronic device of FIG. 1.

FIG. 1 is a perspective view illustrating an electronic device according to an embodiment of the invention. FIG. 2 is a partial perspective view illustrating the electronic device of FIG. 1. FIG. 3 is a schematic diagram illustrating the electronic device of FIG. 1. Referring to FIG. 1 to FIG. 3, an electronic device 100 of the present embodiment includes a first casing 110 and a second casing 120 pivoted with each other, the first casing 110 includes a conductive material, and the second casing 120 includes a conductive material. The electronic device 100 further includes at least one first connecting unit 130 (two are illustrated in FIG. 3) and at least one feeding unit 140 (two are illustrated in FIG. 3). The first connecting units 130, for example, are pivoted units, the first casing 110 and the second casing 120 are pivoted with each other via the pivoted units (the first connecting units 130), and the first connecting units 130 conduct the first casing 110 and the second casing 120 with each other. Each feeding units 140 is electrically connected to the first casing 110 and one of the first connecting units 130.

In the present embodiment, the electronic device 100, for example, is a notebook computer, the first casing 110, for example, is a metal shell of a display screen of the notebook computer, and the second casing 120, for example, is a metal shell of a host of the notebook computer. Under the above-mentioned configuration, the electronic device 100 conducts the first casing 110 and the second casing 120 with each other via the existing pivoted units (the first connecting units 130), configures the feeding units 140, which are electrically connected to the first casing 110 and the first connecting units 130, so as to form an antenna structure via the first casing 110, the second casing 120, the first connecting units 130 and the feeding units 140 for transmitting and receiving an electromagnetic signal, and delivers the electromagnetic signal via the feeding units 140. As a result, the electronic device 100 is not required to be configured with an additional antenna, and may avoid the conductive first casing 110 and second casing 120 from causing interference to a signal of the additional antenna, so as to enhance a signal transmission and reception ability of the electronic device 100.

Referring to FIG. 2 and FIG. 3, in the present embodiment, a lateral side 112 of the first casing 110 and a lateral side 122 of the corresponding second casing 120 have a gap 115 there between, and the first connecting units 130 and the feeding units 140 are all disposed in the gap 115. Furthermore, the first casing 110 and the second casing 120, through the conduction of the feeding units 140, equal to a dipole antenna. The lateral side 112 of the first casing 110 has a distal end 112*a*, the lateral side 122 of the second casing 120 has a distal end 122*a*, and the distal end 112*a* of the lateral side 112 and the distal end 122*a* of the lateral side 122 are adjacent to the first connecting unit 130. A distance between the first connecting unit 130 and the distal end 112*a* of the lateral side 112 and a distance between the first connecting unit 130 and the distal end 122*a* of the lateral side 122 (labeled as L1 in FIG. 3) equal to $(n\times\lambda)/4$, wherein n is an integral number, $\lambda$ is a wavelength of the electromagnetic signal and the symbol "×" represents the multiplication sign, so that the first casing 110 and the second casing 120 are suitable for transmitting and receiving the electromagnetic signal. As shown in FIG. 1, under this configuration, distributions of current E (illustrated in FIG. 3) of an antenna structure formed by the first casing 110, the second casing 120, the first connecting units 130 and the feeding units 140 at an edge of the first casing 110 and an edge of the second casing 120 are in comply with characteristics of the dipole antenna.

Referring to FIG. 1, the electronic device 100 of the present embodiment includes at least one cover 160 (two are illustrated). Each cover 160 is, for example, a nonmetal component. The covers 160 are fixed at the first casing 110 and respectively cover the first connecting units 130 illustrated in FIG. 2 and FIG. 3. Each feeding unit 140 is located between the distal end 112*a* of the lateral side 112 and the corresponding first connecting unit 130, wherein each feeding unit 140 is located near the corresponding first connecting unit 130 and away from the distal end 112*a* of the lateral side 112 to be hidden in the corresponding cover 160 illustrated in FIG. 1, such that the electronic device 100 has better appearance. The feeding unit 140 located near the first connecting unit 130 is equal to a shorting terminal of the abovementioned antenna structure, and a shorting terminal of an antenna structure generally has small impedance. In view of this, a capacitor component is connected in parallel with the feeding point of the feeding unit 140 to increase the impedance of the feeding unit, so as to ensure a resonance of signal at the feeding unit 140, which will be described as follows.

Referring to FIG. 2, the feeding unit 140 of the present embodiment includes a substrate 140*a* and a circuit 140*b* and has a feeding point F and a capacitor component C. The substrate 140*a* is fixed between the first casing 110 and the first connecting unit 130 by screwing or welding. The circuit 140*b* is disposed on the substrate 140*a* and has a connecting end T1 and a connecting end T2 connected to the first casing 110 and the first connecting unit 130 respectively. The feeding point F is located on the circuit 140*b* and connected to a feed line (not shown), so as to transmit an electromagnetic signal to a circuit within the second casing 120 through the feed line. The capacitor component C is disposed on the substrate 140*a* and connected in parallel with the feeding point F through the circuit 140*b*, so as to increase the impedance of the feeding unit 140, such that a resonance of signal at the feeding unit 140 is ensured.

Figure 4:
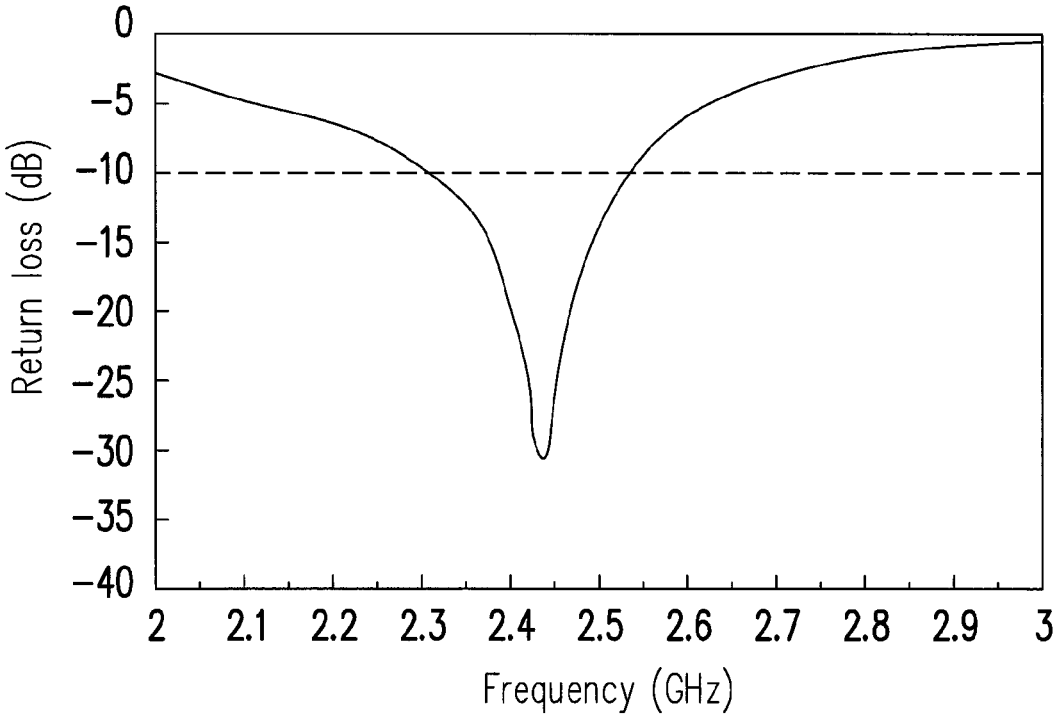
FIG. 4 illustrates a return loss curve of an antenna structure formed by a first casing and a second casing of FIG. 3.

FIG. 4 illustrates a return loss curve of an antenna structure formed by a first casing and a second casing of FIG. 3. A radiation efficiency table (which is referred to as table 1) of the antenna structure formed by the first casing 110 and the second casing 120 of FIG. 3 is as follows:

| | Freq. (GHz) | | |
|---|---|---|---|
| | 2.4 | 2.45 | 2.5 |
| Return loss (dB) | −19.12 | −25.70 | −13.53 |
| Efficiency (%) | 97.07 | 95.45 | 89.91 |

It may be seen from the return loss curve in FIG. 4 that, an operation bandwidth of the antenna structure formed by the first casing 110 and the second casing 120 shown in FIG. 3 may cover an operating frequency band (2.4 to 2.5 GHz) required by a wireless local area network (WLAN). In addition, it may be seen from table 1 that, within the operating frequency (2.4 to 2.5 GHz) required by the wireless local area network, a radiation efficiency of the antenna structure formed by the first casing 110 and the second casing 120 shown in FIG. 3 is approximately between 89.91% to 97.07%, and in comply with a basic communication performance required for electronic products.

Figure 5:
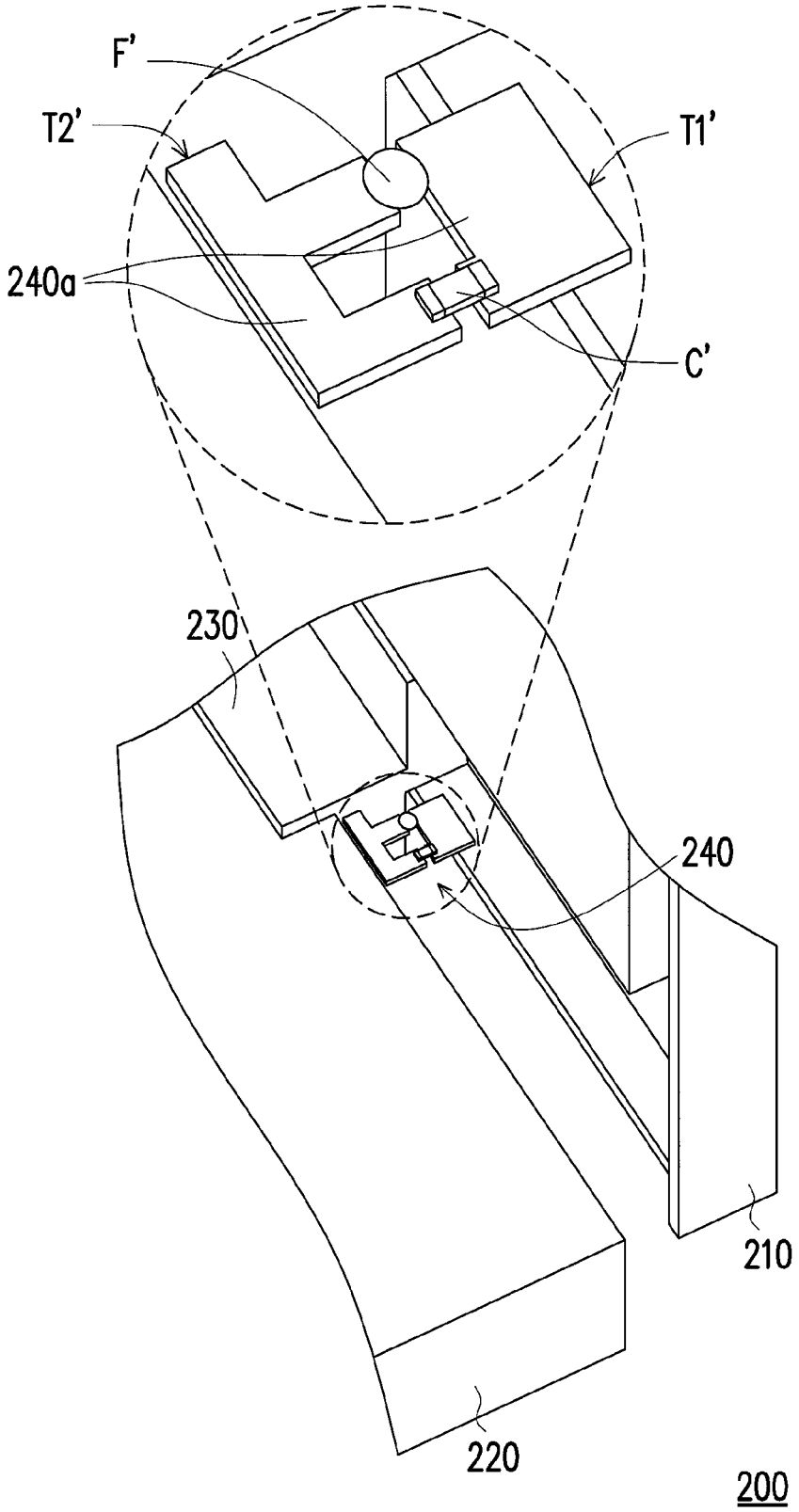
FIG. 5 is a partial perspective view illustrating an electronic device according to another embodiment of the invention.

The invention is not intended to limit the structure of the feeding unit, which will be described as follows by FIG. 5. FIG. 5 is a partial perspective view illustrating an electronic device according to another embodiment of the invention. Referring to FIG. 5, in the electronic device 200 of the present embodiment, the configuration of the first casing 210, the second casing 220 and the first connecting unit 230 is similar to the configuration of the first casing 110, the second casing 120 and the first connecting unit 130 of the abovementioned electronic device 100, and a relevant description thereof is not repeated herein. A difference between the electronic device 200 and the electronic device 100 is that the feeding unit 240 includes a metal component 240*a* fixed between the first casing 210 and the first connecting unit 230. The metal component 240*a* has a connecting end T1' and a connecting end T2' connected to the first casing 210 and the first connecting unit 230 respectively. The feeding point F' is located on the metal component 240*a*, and the capacitor component C' is disposed on the metal component 240*a* and connected in parallel with the feeding point F' through the metal component 240*a*.

Figure 6:
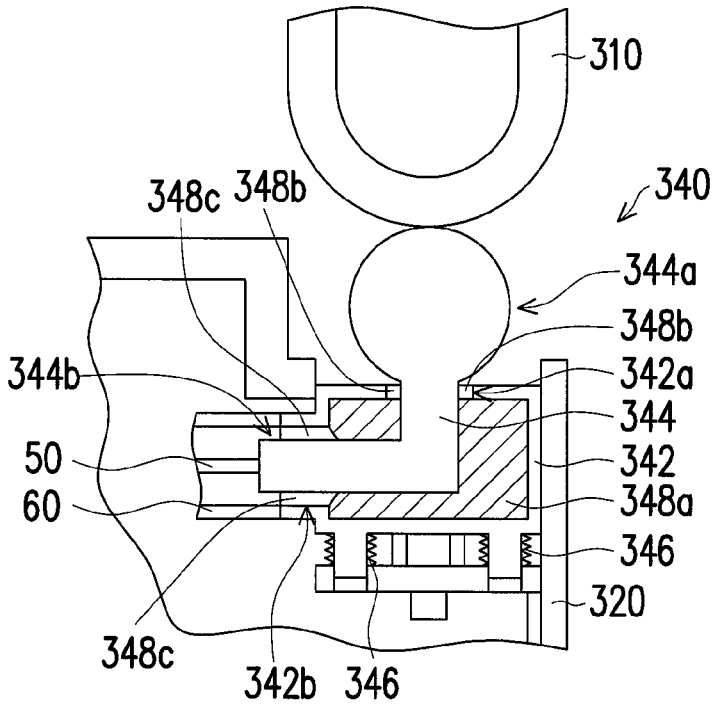
FIG. 6 is a partial enlarged diagram illustrating an electronic device according to another embodiment of the invention.

Partial structure of the feeding unit could be configured as follows. FIG. 6 is a partial enlarged diagram illustrating an electronic device according to another embodiment of the invention. Referring to FIG. 6, the feeding unit 340 of the present embodiment includes a base body 342, a conductive element 344 and at least one elastic element 346 (two are illustrated). The base body 342 is disposed within the second casing 320. The conductive element 344 is disposed on the base body 342, wherein a first end 344*a* of the conductive element 344 is in contact with the first casing 310, and a second end 344*b* of the conductive element 344 is connected to a feed line 50, so as to transmit an electromagnetic signal to a circuit within the second casing 320 through the feed line 50. The elastic element 346, for example, is a spring and connects between the base body 342 and the second casing 320, so that the conductive element 344 can be in continuous contact with the first casing 310 via an elastic force of the elastic element 346, and thereby enables the electromagnetic signal to be delivered through the conductive element 344 and the feed line 50, indeed. In the embodiment depicted by FIG. 6, the first end 344*a* of the conductive element 344, which is configured to contact the first casing 310 is, for example, a spherical structure; however, in other embodiments, the first end 344*a* may also be a structure of other suitable shape, such as a pillar structure or a sheet structure, and the invention is not limited thereto. Furthermore, under a condition when the first end 344*a* of the conductive element 344 is the sheet structure, the first end 344*a* is, for example, an elastic structure, so that the conductive element 344 can be in continuous contact with the first casing 310 via the elastic force of the elastic structure. In the present embodiment, the base body 342 of the feeding unit 340 is disposed within the second casing 320; however, the invention is not limited thereto; and in other embodiments, the base body 342 of the feeding unit 340 may also be disposed within the first casing 310.

In the present embodiment, the base body 342 includes a conductive material. The base body 342 is connected to a ground wire 60 and in contact with the second casing 320, so as to enable the second casing 320 to be grounded via the base body 342 and the ground wire 60.

As shown in FIG. 6, in the present embodiment, a portion of the conductive element 344 is located within the base body 342. The feeding unit 340 may further include an insulating element 348*a*, and the insulating element 348*a* is filled in the base body 342 so as to electrically isolate the conductive element 344 from the base body 342, and to firmly fix the conductive element 344 in the base body 342 for avoiding the conductive element 344 from being in conduct with the base body 342 and influencing the delivering of the electromagnetic signal. In addition, an insulating element 348*b* and an insulating element 348*c* may be respectively disposed at an opening 342*a* and an opening 342*b* of the base body 342, so that the conductive element 344 may be firmly fixed in the base body 342, and thereby ensure that the conductive element 344 passing through the opening 342*a* and the opening 342*b* is not to be in conduct with the base body 342. Furthermore, the insulating elements (348*a*, 348*b*, 348*c*) are configured to electrically isolate the conductive element 344 from the base body 342 and fix the conductive element 344 in the base body 342, and thereby capable of avoiding the delivering of electromagnetic signal to be influenced as the conductive element 344 and the base body 342 are being conducted with each other. In other embodiments, it is also possible not to fill the insulating element 348*a* in the base body 342, and the conductive element 344 is fixed in the base body 342 via the insulating element 348*b* and the insulating element 348*c*, and the invention is not limited thereto.

Figure 7:
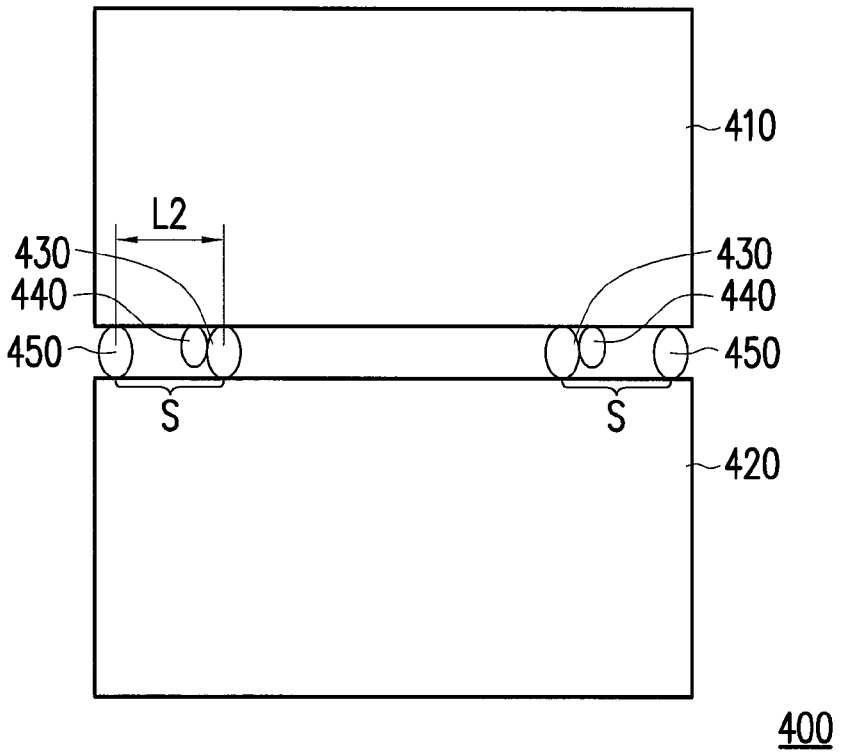
FIG. 7 is a schematic diagram illustrating an electronic device according to another embodiment of the invention.

FIG. 7 is a schematic diagram illustrating an electronic device according to another embodiment of the invention. In the electronic device 400 of FIG. 7, the configuration of the first casing 410, the second casing 420, the first connecting units 430 and the feeding units 440 is similar to the configuration of the first casing 110, the second casing 120, the first connecting units 130 and the feeding units 140 of the abovementioned electronic device 100, and a relevant description thereof is not repeated herein. A difference between the electronic device 400 and the electronic device 100 is that the electronic device 400 includes at least one second connecting unit 450 (two are illustrated). The second connecting units 450 conduct the first casing 410 and the second casing 420 with each other. Slots S are formed between the first casing 410, the second casing 420, the first connecting units 430 and the second connecting units 450. A length L2 of each slot S equals to $(n\times\lambda)/2$, wherein n is an integral number, $\lambda$ is a wavelength of the electromagnetic signal and the symbol "×" represents the multiplication sign, so that the first casing 410 and the second casing 420 is equivalent to a slot antenna.

In summary, the electronic device of the invention conducts the first casing and the second casing with each other through the first connecting unit, and is configured with the feeding unit that connects the first casing, so as to transmit and receive the electromagnetic signal via the antenna structure formed by the first casing, the second casing, the first connecting unit and the feeding unit, and to deliver the electromagnetic signal via the feeding unit. As a result, the electronic device is not required to be configured with an additional antenna, and may avoid the conductive first casing and second casing from causing interference to a signal of the additional antenna, so as to enhance the signal transmission and reception ability of the electronic device. Besides, the feeding unit is located near the first connecting unit to be hidden in the cover corresponding to the first connecting unit, such that the electronic device has better appearance. The feeding unit located near the first connecting unit is equal to a shorting terminal of the abovementioned antenna structure, and a shorting terminal of an antenna structure generally has small impedance. In view of this, the capacitor component of the feeding unit is connected in parallel with the feeding point of the feeding unit, so that the impedance of the feeding unit is increased to ensure a resonance of signal at the feeding unit.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. An electronic device comprising:

a first casing, wherein the first casing comprises a conductive material;

a second casing, wherein the second casing comprises a conductive material;

at least one first connecting unit conducting the first casing and the second casing with each other; and at least one feeding unit electrically connected to the first casing and having a feeding point and a capacitor component, wherein the capacitor component is connected with the feeding point, and the electronic device forms an antenna structure with the first casing, the second casing, the first connecting unit and the feeding unit, and transmits an electromagnetic signal via the feeding unit, wherein the capacitor component and the feeding point located in the same feeding unit are electrically connected in parallel with each other, and the feeding unit is physically separated from the second casing, and wherein the feeding unit and the first connecting unit are directly and physically connected with each other.

2. The electronic device as recited in claim 1, further comprising a cover, wherein the cover is fixed on the first casing and covers the first connecting unit, and the feeding unit is disposed in the cover.

3. The electronic device as recited in claim 1, wherein the feeding unit is electrically connected to the first connecting unit.

4. The electronic device as recited in claim 1, wherein the feeding unit comprises a substrate and a circuit, the substrate is fixed between the first casing and the first connecting unit, the circuit is disposed on the substrate and has two connecting ends connected to the first casing and the first connecting unit respectively, the feeding point is located on the circuit, and the capacitor component is disposed on the substrate and connected with the feeding point through the circuit.

5. The electronic device as recited in claim 1, wherein the feeding unit comprises a metal component, the metal component is fixed between the first casing and the first connecting unit and has two connecting ends connected to the first casing and the first connecting unit respectively, the feeding point is located on the metal component, and the capacitor component is disposed on the metal component and connected with the feeding point through the metal component.

6. The electronic device as recited in claim 1, wherein a lateral side of the first casing and a lateral side of the corresponding second casing have a gap there between, and the first connecting unit and the feeding unit are disposed in the gap.

7. The electronic device as recited in claim 6, wherein each lateral side has a distal end, the distal end is adjacent to the first connecting unit, and the feeding unit is located between the distal end and the first connecting unit and near the first connecting unit.

8. The electronic device as recited in claim 6, wherein each lateral side has a distal end, the distal end is adjacent to the first connecting unit, and a distance between the first connecting unit and the distal end of each lateral side equals to $(n\times\lambda)/4$, wherein n is an integral number, and $\lambda$ is a wavelength of the electromagnetic signal.

9. The electronic device as recited in claim 1, further comprising at least one second connecting unit, wherein the second connecting unit conducts the first casing and the second casing with each other, and the first casing, the second casing, the first connecting unit and the second connecting unit form a slot there between.

10. The electronic device as recited in claim 9, wherein a length of the slot equals to $(n\times\lambda)/2$, wherein n is an integral number, and $\lambda$ is a wavelength of the electromagnetic signal.

11. The electronic device as recited in claim 1, wherein the feeding unit comprising:

a base body disposed within the second casing;

a conductive element disposed on the base body, wherein a first end of the conductive element is in contact with the first casing, a second end of the conductive element is connected to a feed line; and an elastic element connected between the base body and the second casing, wherein the conductive element is in continuous contact with the first casing via an elastic force of the elastic element.

12. The electronic device as recited in claim 11, wherein the first end of the conductive element is a spherical structure, a pillar structure or a sheet structure.

13. The electronic device as recited in claim 11, wherein the conductive element comprises an elastic structure.

14. The electronic device as recited in claim 11, wherein the base body comprises a conductive material, and the base body is connected to a ground wire and in contact with the second casing.

15. The electronic device as recited in claim 14, wherein the feeding unit further comprises:

an insulating element, wherein a portion of the conductive element is located within the base body, the insulating element is filled in the base body so as to electrically isolate the conductive element from the base body.

16. The electronic device as recited in claim 1, wherein the first connecting unit is a pivoted unit, and the first casing and the second casing are pivoted with each other through the pivoted unit.

* * * * *